US007671291B2

(12) United States Patent
Odanaka

(10) Patent No.: US 7,671,291 B2
(45) Date of Patent: Mar. 2, 2010

(54) OPERATIONS PANEL AND IMAGE FORMING APPARATUS

(75) Inventor: Satoshi Odanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 794 days.

(21) Appl. No.: 11/552,599

(22) Filed: Oct. 25, 2006

(65) Prior Publication Data

US 2007/0114335 A1 May 24, 2007

(30) Foreign Application Priority Data

Nov. 21, 2005 (JP) ..... 2005-335586

(51) Int. Cl.
*H01H 13/52* (2006.01)

(52) U.S. Cl. ..... 200/345; 200/5 A

(58) Field of Classification Search ..... 200/5 A, 200/345, 341, 520, 517
See application file for complete search history.

(56) References Cited

U.S. PATENT DOCUMENTS 4,556,769 A * 12/1985 Inaba ..... 200/345
4,677,268 A * 6/1987 Nemeth et al. ..... 200/513
4,689,455 A * 8/1987 Watanabe ..... 200/534
5,034,602 A * 7/1991 Garcia et al. ..... 250/227.22
5,256,843 A * 10/1993 Chiba et al. ..... 200/517
5,496,977 A * 3/1996 Date et al. ..... 200/6 A
5,612,692 A * 3/1997 Dugas et al. ..... 341/22
5,710,397 A * 1/1998 Liao ..... 200/5 A
5,810,491 A * 9/1998 Muller et al. ..... 400/496
5,824,978 A * 10/1998 Karasik et al. ..... 200/18
5,934,453 A * 8/1999 Sugawara et al. ..... 200/339
6,054,939 A * 4/2000 Wei et al. ..... 341/20
6,191,776 B1 * 2/2001 Hu ..... 345/168
6,239,391 B1 * 5/2001 Nishijima et al. ..... 200/5 A
6,354,210 B1 * 3/2002 Chao ..... 101/472
6,455,795 B1 * 9/2002 Murakami et al. ..... 200/345
6,467,683 B2 * 10/2002 Jun ..... 235/145 R
6,467,924 B2 * 10/2002 Shipman ..... 362/600
6,590,508 B1 * 7/2003 Howell et al. ..... 341/22
6,917,000 B2 * 7/2005 Yen ..... 200/5 A
7,030,330 B2 * 4/2006 Suda ..... 200/302.2
7,038,598 B2 * 5/2006 Uke ..... 341/20
7,283,066 B2 * 10/2007 Shipman ..... 341/22
7,335,843 B2 * 2/2008 Chan et al. ..... 200/310
7,365,281 B2 * 4/2008 Yamaguchi et al. ..... 200/302.1

(Continued)

FOREIGN PATENT DOCUMENTS

JP 7-85751 3/1995

(Continued)

*Primary Examiner*—Ross N Gushi
(74) *Attorney, Agent, or Firm*—Oblon, Spivak, McClelland, Maier & Neustsdt, L.L.P.

(57) ABSTRACT

An operations panel wherein a board having an upper surface where a plurality of switches is provided is provided in a housing, the operations panel includes a base where the board is arranged; a cover forming the housing together with the base, the cover having an upper surface having a part where a plurality of concave parts is formed in positions corresponding to the switches; a plurality of key tops provided at the concave parts from outside in a state where operations parts and projection parts including engaging claws are inserted via a plurality of openings formed in the concave parts; and an intermediate member provided between the cover and the board.

8 Claims, 13 Drawing Sheets

U.S. PATENT DOCUMENTS

| | | | | |
|---|---|---|---|---|
| 7,456,369 | B2 * | 11/2008 | Watanabe | 200/341 |
| 7,504,596 | B2 * | 3/2009 | Chou | 200/5 A |
| 7,578,630 | B2 * | 8/2009 | Watanabe et al. | 400/714 |
| 2004/0140183 | A1 * | 7/2004 | Yen | 200/5 A |
| 2005/0109883 | A1 * | 5/2005 | Watanabe et al. | 248/27.1 |
| 2007/0007113 | A1 * | 1/2007 | Watanabe | 200/5 A |

FOREIGN PATENT DOCUMENTS

| | | |
|---|---|---|
| JP | 10-40772 | 2/1998 |
| JP | 2002-270058 | 9/2002 |

* cited by examiner (A)
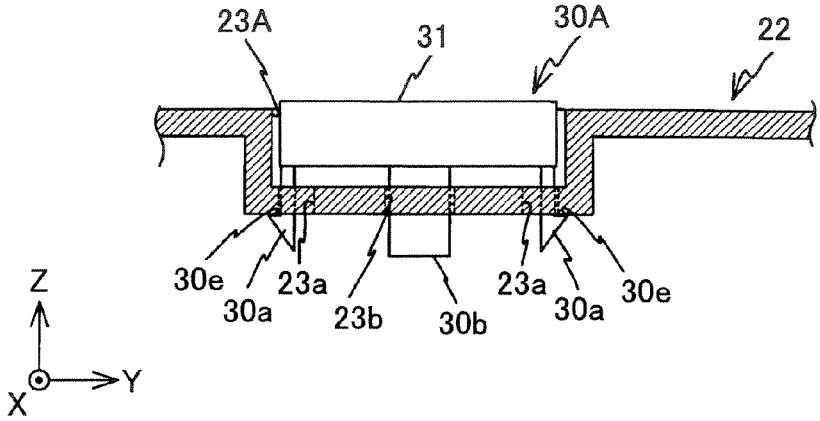
FIG.5
(B)
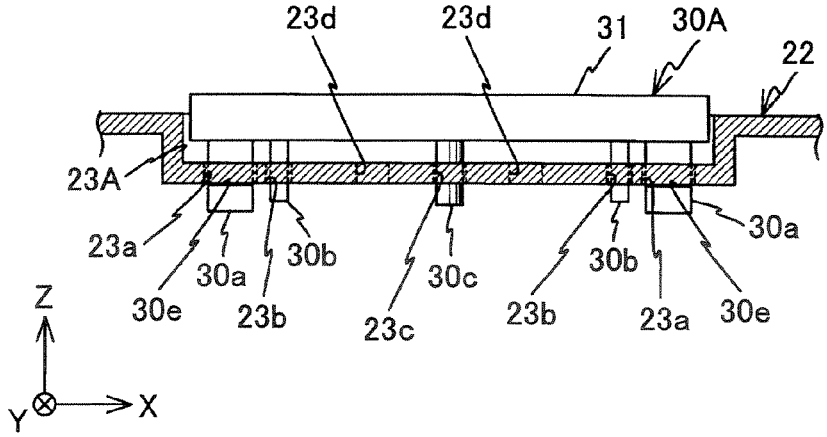

OPERATIONS PANEL AND IMAGE FORMING APPARATUS

BACKGROUND OF THE INVENTION

1. Field of the Invention

The present invention generally relates to operations panels and image forming apparatuses, and more particularly an operations panel having a push-button mechanism having a key top and an image forming apparatus having the operations panel.

2. Description of the Related Art

Plural optional keys corresponding to functions or operations of an image forming apparatus having plural functions such as a copier or printer are arranged on a surface of an interface of the image forming apparatus. A key top of the optional keys has a structure where, for example, a pressing part pressed from outside and a flexible claw for engaging a housing of the apparatus or the like are formed in a body by plastic injection molding. The key top is fitted in the housing by the flexible claw in a state where only designated sliding is permitted. See, for example, Japanese Laid-Open Patent Application Publication No. 7-85751.

Since a hinge structure cannot be applied to the key top and the housing, after the key top is fitted in the housing from the outside, due to unevenness of clearance between a key boss provided at the key top in order to operate a switch and the switch, the key top may be vibrated so that strange noise may be generated. In addition, due to fall of the key top from the surface of the housing, operations feeling may be damaged.

Furthermore, in the interface of the copier or the like, plural neighboring key tops having different functions but common configurations of operations surfaces are frequently arranged. In this case, since the distance between the switch and the key top is the same in each of the key tops, it is possible to commonly use the key top having the same configuration by printing an indication on the operations surface of the key top having the designated length different. However, depending on a design configuration of a cover of the operations panel or a housing of the copier or the like having the key top, it may be necessary to make the length of the key boss different, depending on the arrangement position of the key top. Therefore, the key tops having the same configurations may not be commonly used.

SUMMARY OF THE INVENTION

Accordingly, embodiments of the present invention may provide a novel and useful operations panel and image forming apparatus in which the above-mentioned problems are eliminated.

More specifically, the embodiments of the present invention may provide a push-button mechanism whereby manufacturing cost can be reduced by making parts common and operability can be improved.

The embodiments of the present invention may also provide an operations panel whereby manufacturing cost can be reduced by making parts common and operability can be improved and an image forming apparatus having the operations panel.

One aspect of the present invention may be to provide an operations panel wherein a board having an upper surface where a plurality of switches is provided is provided in a housing, the operations panel including: a base where the board is arranged; a cover forming the housing together with the base, the cover having an upper surface having a part where a plurality of concave parts is formed in positions corresponding to the switches; a plurality of key tops provided at the concave parts from outside in a state where operations parts and projection parts including engaging claws are inserted via a plurality of openings formed in the concave parts; and an intermediate member provided between the cover and the board, the intermediate member including a plurality of elastic members, a plurality of spacers, and a main body where the elastic members and the spacers are provided in a body, the elastic members individually giving an energizing force in a direction separating the switches from the corresponding key tops, the spacers having thicknesses corresponding to gaps between the operations parts of the key tops and the corresponding switches and individually moving in the same directions accompanying movement of the key tops, the directions approaching to or separating from the corresponding switches.

Another aspect of the present invention may be to provide an image forming apparatus, including: the operations panel as mentioned above; and an image forming apparatus main body where the operations panel is at least electrically connected.

The operations panel mentioned above is proper for inputting a command to the image forming apparatus. In addition, the image forming apparatus mentioned above is proper for forming an image based on the input command.

Other objects, features, and advantages of the present invention will become more apparent from the following detailed description when read in conjunction with the accompanying drawings.

BRIEF DESCRIPTION OF THE DRAWINGS

FIG. 5 is a side view showing a state where the key top 30A is installed;

DETAILED DESCRIPTION OF THE PREFERRED EMBODIMENTS

A description of the present invention is now given, with reference to FIG. 1 through FIG. 13, including embodiments of the present invention.

Figure 1:
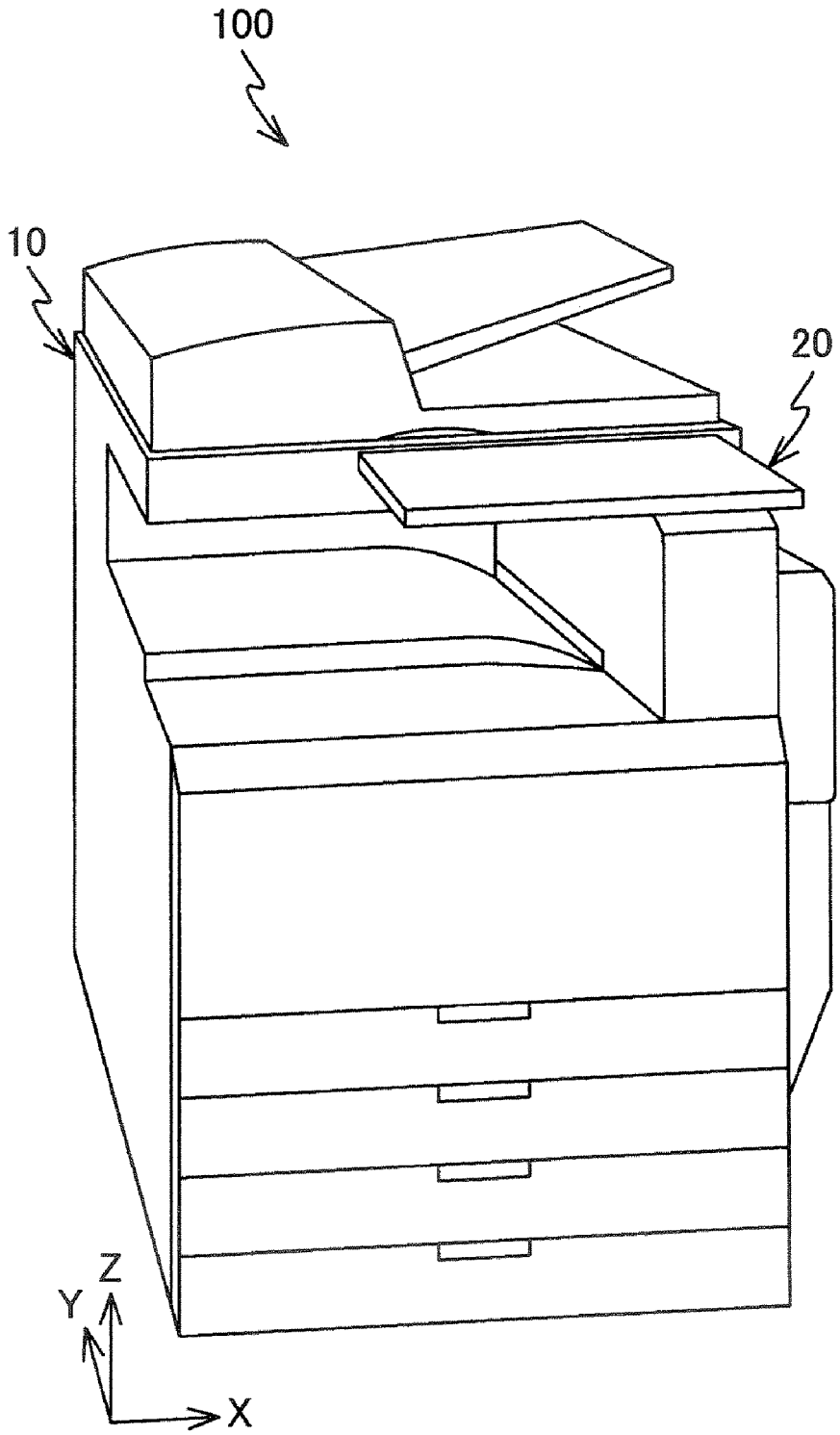
FIG. 1 is a perspective view of a copier 100 of an embodiment of the present invention.

FIG. 1 is a perspective view of a copier 100 which is an image forming apparatus of an embodiment of the present invention.

Referring to FIG. 1, the copier 100 includes a copier main body 10 and an operations panel 20. The copier main body 10 has a substantially rectangular parallelepiped configuration. The copier main body 10 reads an image of a manuscript that is a subject of copying based on a command from a user so as to make a copy on a sheet. The operations panel 20 is fixed to an upper end part of a front surface (−Y side surface in FIG. 1) of the copier main body 10.

The copier main body 10 includes a scanner device, an optical scanning device, a transferring device, a communication device, a control device, and others, not shown in FIG. 1. The scanner device reads out image information of the manuscript that is the subject of copying. The optical scanning device forms a latent image on a photosensitive body based on the image information read out by the scanner device. The transferring device makes visible the latent image on the photosensitive body by using toner or the like so as to transfer the image onto the sheet. The communication device receives an input signal from the operations panel. These devices are controlled by the control device. The copier main body 10 includes an auto sheet feeder for automatic feeding the sheet.

Figure 2:
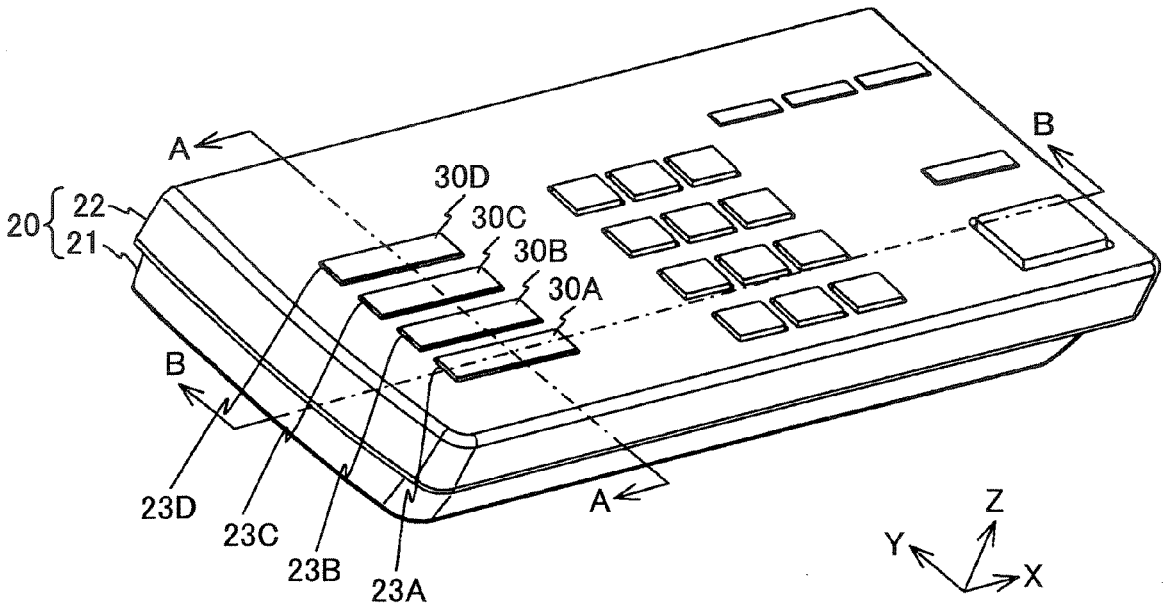
FIG. 2 is a perspective view showing an operations panel 20 of the copier 100.

FIG. 2 is a perspective view showing the operations panel 20 of the copier 100. As shown in FIG. 2, the operations panel 20 includes a cover 22 and a base 21 which are engaged with each other in upper and lower directions and which have U-shaped cross-sections of an X-Z plane.

The cover 22 is formed by, for example, plastic injection molding. In the vicinity of an end part at −X side of the upper surface of the cover 22, concave parts 23A, 23B, 23C, and 23D are provided at even intervals. The concave parts 23A, 23B, 23C, and 23D are arranged so as to extend from the vicinities of end parts of −Y side in +Y direction. Longitudinal directions of the concave parts 23A, 23B, 23C, and 23 D are +X and −Y directions.

Plastic key tops 30A, 30B, 30C and 30D are fitted in the concave parts 23A, 23B, 23C, and 23D, respectively. The plastic key tops 30A, 30B, 30C and 30D form, for example, functional keys configured to set functions of the copier 100.

In addition, plural key tops forming a ten-key are provided in the vicinity of a center part of the upper surface of the cover 22. The key tops are fitted in openings formed in the upper surface of the cover 22 from a lower part.

Figure 3:
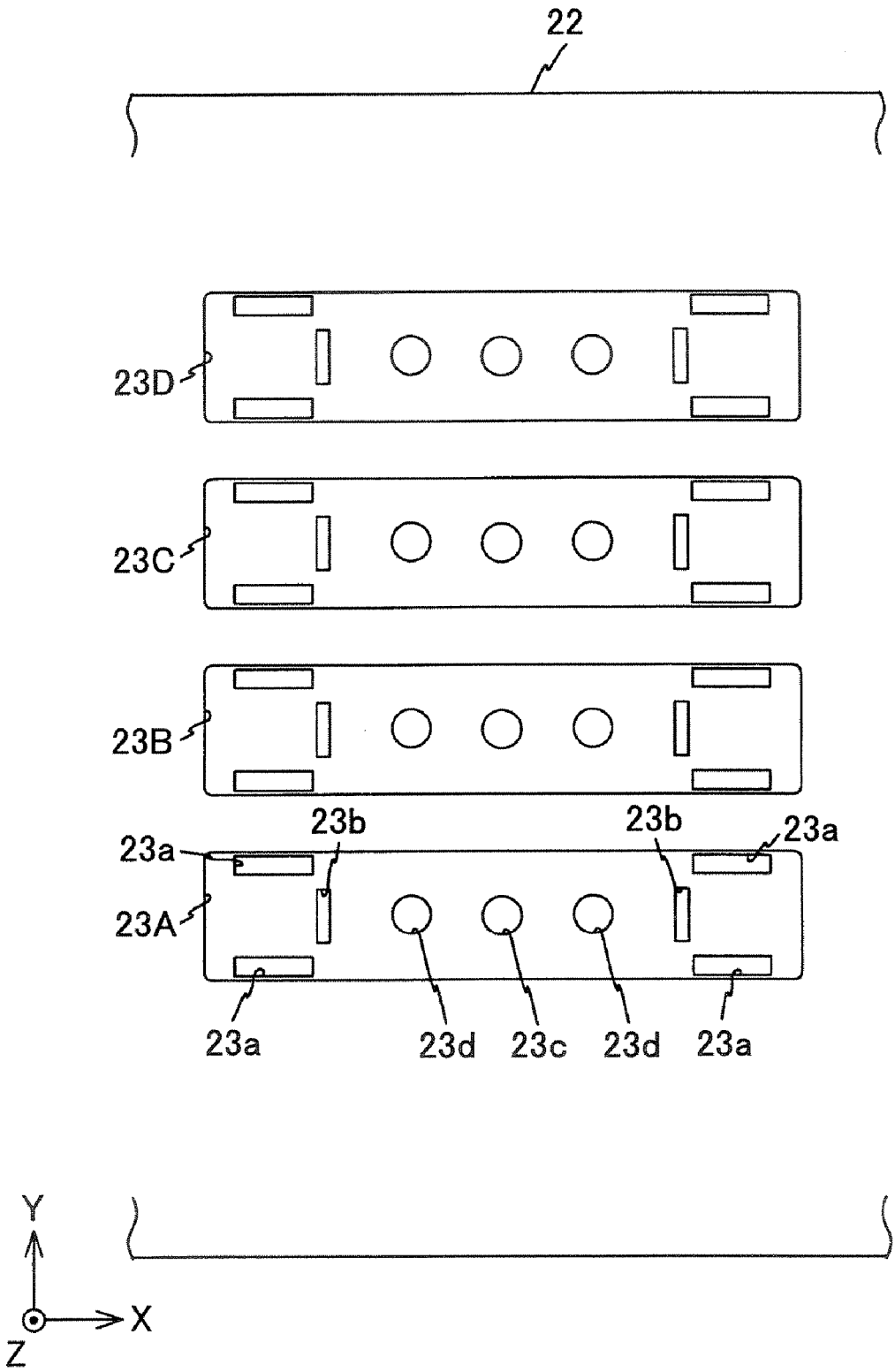
FIG. 3 is a view for explaining concave parts 23A through 23D formed in the cover 22.

FIG. 3 is a view for explaining four concave parts 23A through 23D formed in the cover 22. Since the structure of the concave part 23A is identical with structures of the concave parts 23B, 23C, and 23D, details of the structure of the concave part 23A are illustrated in FIG. 3, and explanation and illustration in FIG. 3 of details of the structures of the concave parts 23B, 23C, and 23D are omitted.

As shown in FIG. 3, in the vicinities of four corners of an internal bottom surface of the concave part 23A, openings 23*a* having rectangular configurations are formed. Longitudinal directions of the openings 23*a* are +X and −X directions. A circular hole forming part 23*c* is formed in the center of the concave part 23A. A pair of circular hole forming parts 23*d* is formed straddling in the X directions the circular hole 23*c*. A pair of openings 23*b* is formed so that the pair of the circular hole forming parts 23*d* is put between the openings 23*b*. Longitudinal directions of the openings 23*b* are +Y and −Y directions.

Each of the key tops 30A through 30D has the same configuration while the function of each of the key tops 30A through 30D is different. Therefore, the key top 30A is discussed in the following explanation, and explanations of the key tops 30B, 30C, and 30D are omitted.

Figure 4:
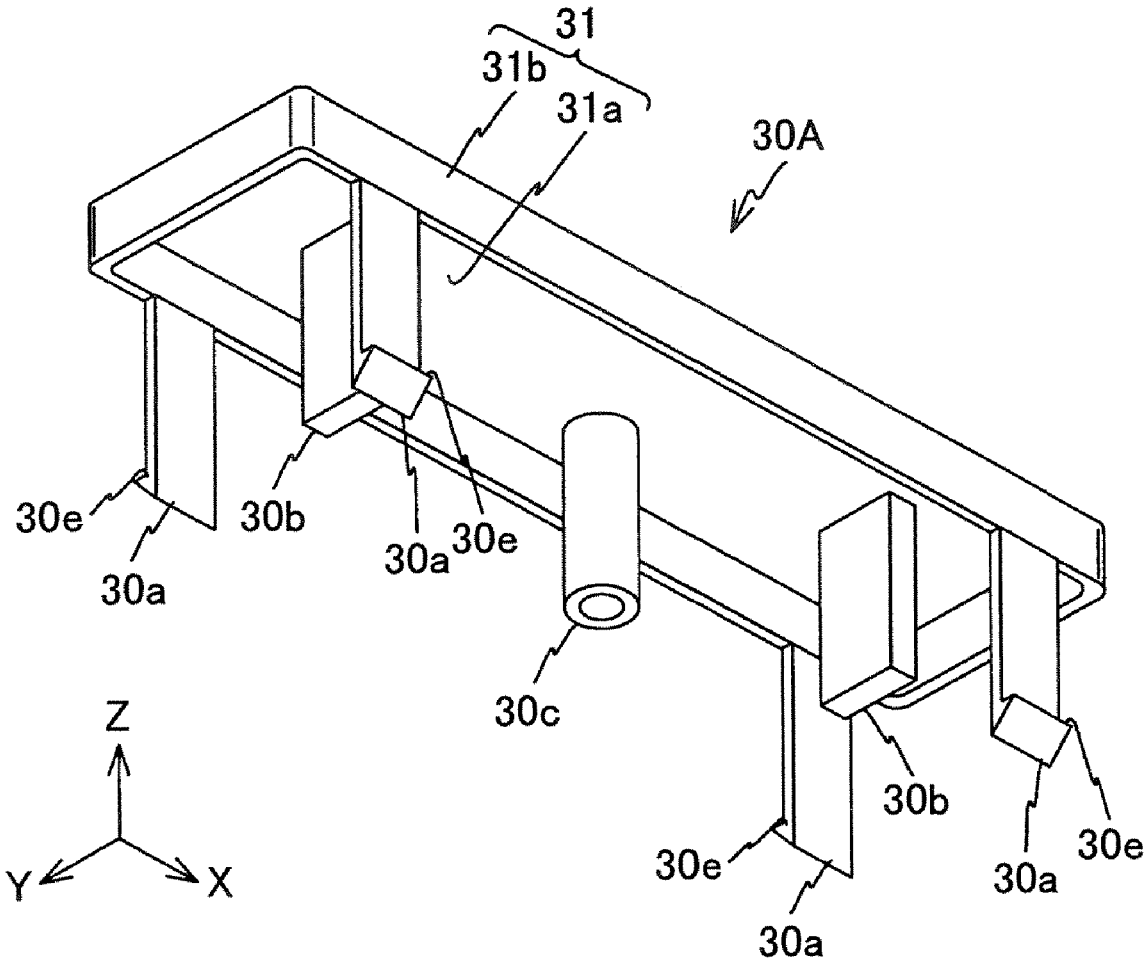
FIG. 4 is a perspective view of a key top 30A fitted in the concave part 23A.

FIG. 4 is a perspective view of the key top 30A fitted in the concave part 23A.

As shown in FIG. 4, the key top 30A has a key top main body 31, four leg parts 30*a*, a pair of guide ribs 30*b*, and an operations part 30*c*.

The key top main body 31 has a U-shaped cross section. The longitudinal direction of the key top main body 31 is +X and −X directions. The leg parts 30*a* are formed in the vicinities of four corners of the key top main body 31. The operations part 30*c* having a cylindrical shaped configuration is formed in the center of a lower surface of the key top main body 31. The operations part 30*c* is put between the guide ribs 30*b* having rectangular parallelepiped shape configurations.

The key top main body 31 includes a pressing part 31*a* and a frame part 31*b*. The pressing part 31*a* has a rectangular shaped configuration. The longitudinal direction of the pressing part 31*a* is +X and −X directions. The frame part 31*b* having a rectangular shaped configuration is formed along an outer edge of a lower surface of the pressing part 31*a*.

The leg parts 30*a* are provided in the vicinities of lower ends of corners of the frame part 31*b*. Hook parts 30*e* are formed at end parts at −Z ends of the leg parts 30*a*. More specifically, at a pair of the leg parts 30*a* formed at +Y side of the frame part 31*b*, the hook parts 30*e* are formed so as to be extended in +Y direction. At a pair of the leg parts 30*a* formed at −Y side of the frame part 31*b*, the hook parts 30*w* are formed so as to be extended in −Y direction.

The operations part 30*c* having a cylindrical shaped configuration whose longitudinal direction is +Z and −Z directions is formed in the center of the lower surface of the key top main body 31. The guide ribs 30*b* are formed at the +X side and the −X side of the operations part 30*c* so that longitudinal directions in X-Y planes of the guide ribs 30B are +Y and −Y directions.

The key tops 30A through 30D are fitted in the concave parts 23A through 23D, respectively, formed in the upper surface of the cover 22 shown in FIG. 3. Details of this fitting structure are discussed by using the key top 30A as an example with reference to FIG. 5.

Here, FIG. 5 is a side view showing the key top 30A installed in the concave part 23A. More specifically, FIG. 5(A) is a view seen from a +X side and a FIG. 5(B) is a view seen from a −Y side.

As shown in FIG. 5(A) and FIG. 5(B), four leg parts 30*a* of the key top 30A are inserted in the openings 23*a* formed at four corners of a bottom wall of the concave part 23A from an upper side of the concave part 23A of the cover. The operations part 30*c* of the key top 30A is inserted in the circular hole forming part 23*c* formed in the center of the bottom wall of the concave part 23A. The guide ribs 30*b* of the key top 30A are inserted in the openings 23*b* formed in the bottom wall part of the concave part 23A. As a result of this, the key top 30A is fitted in the cover 22 so that the pressing part 31*a* of the key top main body 31 is slightly exposed above the plane of the upper surface of the cover 22. In this fitted key top 30A, as shown in FIG. 5(A), the hook part 30*e* provided at the leg part 30*a* is permitted to be moved in +Z and −Z directions between a position where the hook part 30*e* comes in contact with the lower surface of the bottom wall of the concave part 23A and a position where the lower end of the frame part 31*b* (see FIG. 4) of the key top main body 31 comes in contact with the upper surface of the bottom wall of the concave part 23A.

Figure 6:
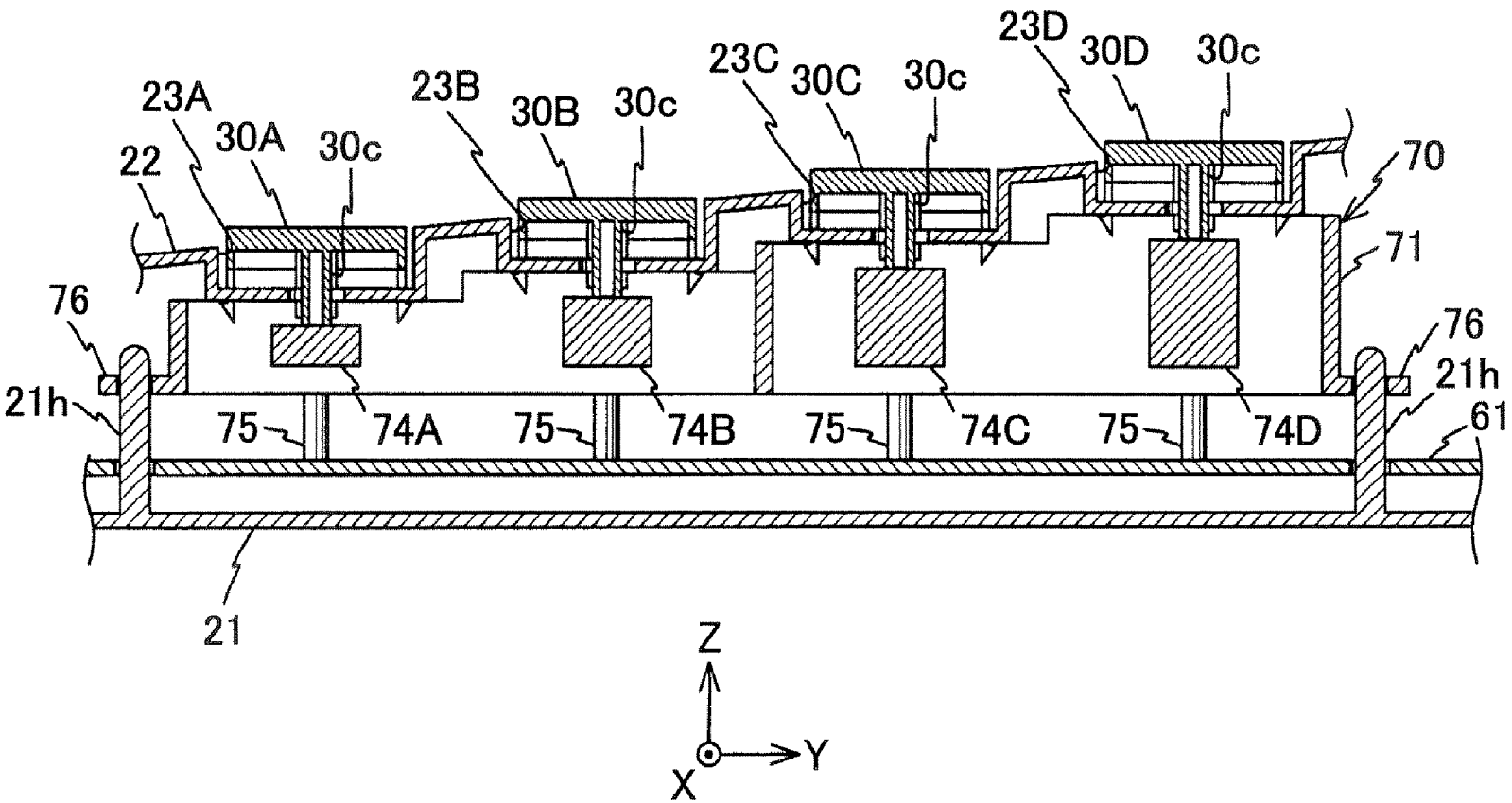
FIG. 6 is a partial cross-sectional view showing a cross-section taken along a line A-A of FIG. 2.

FIG. 6 is a partial cross-sectional view showing a cross-section taken along a line A-A of FIG. 2.

As shown in FIG. 6, at lower parts of the concave parts 23A, 23B, 23C, and 23D where the key tops 30A, 30B, 30C, and 30D are fitted, a board 61 where electronic parts are mounted is supported by the base 21 via a supporting part not shown in FIG. 6. Four switches, discussed below, and an intermediate member 70 are arranged on the board 61. The intermediate member 70 includes spacers 74A, 74B, 74C, and 74D configured to energize the key tops 30A, 30B, 30C, and 30D in the +Z direction and transmit pressing forces to corresponding switches when the key tops 30A, 30B, 30C, and 30D receive pressing forces.

Figure 7:
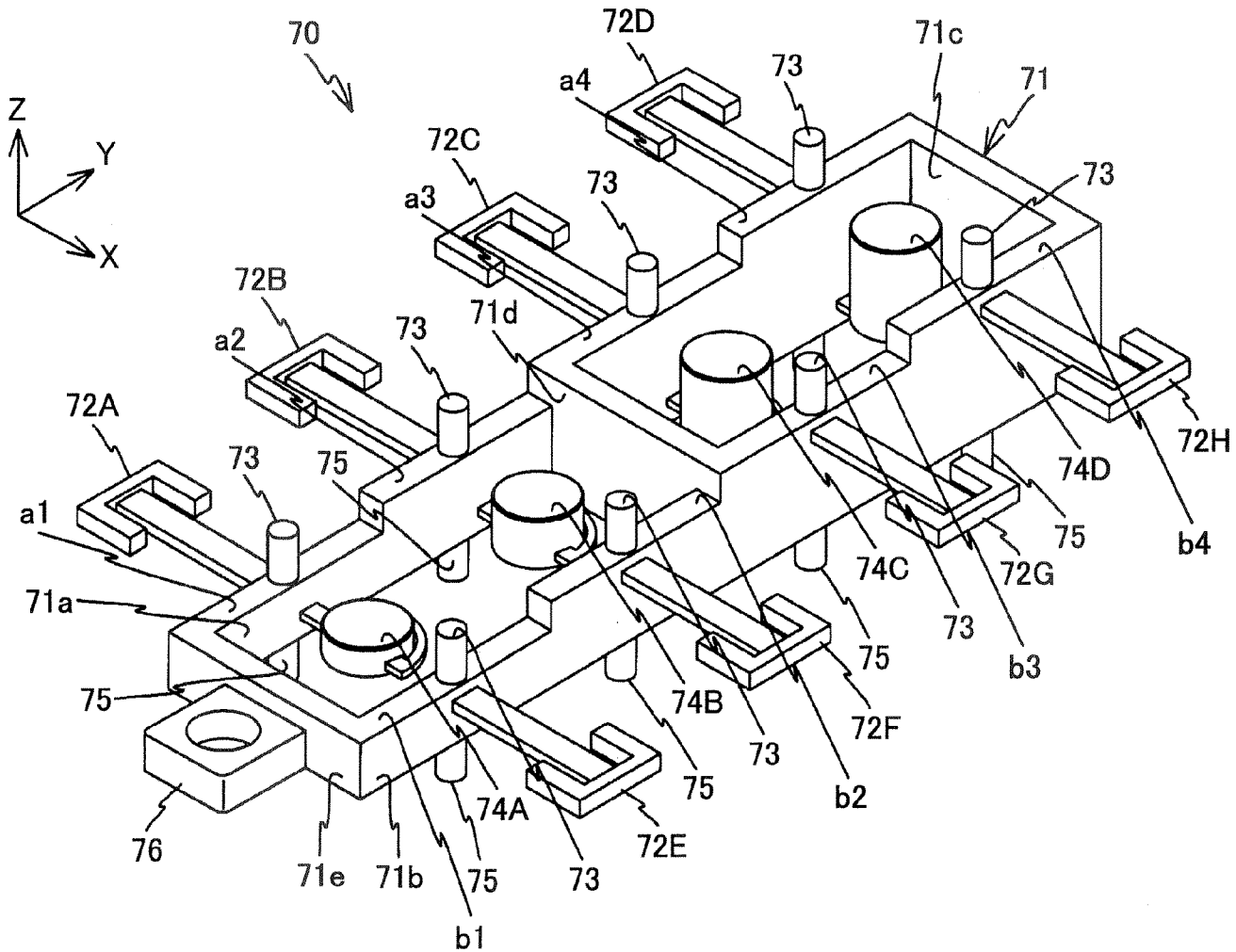
FIG. 7 is a perspective view showing an intermediate member 70.

FIG. 7 is a perspective view showing the intermediate member 70.

As shown in FIG. 7, the intermediate member 70 includes a frame 71, eight elastic hinges 72A, 72B, 72C, 72D, 72E, 72F, 72G, and 72H, eight stoppers 73, eight leg parts 75, four spacers 74A, 74B, 74C, and 74D, and a pair of extending parts 76. The elastic hinges 72A, 72B, 72C, 72D, 72E, 72F, 72G, and 72H are provided on external circumferential parts of the frame 71. The stoppers 73 are provided at an upper end part of the frame 71. The leg parts 75 are provided at a lower end part of the frame 71. The spacers 74A, 74B, 74C, and 74D are provided inside of the frame 71. The extending parts 76 are formed one at each end in +Y and −Y directions of the frame 71.

The frame 71, as shown in FIG. 7 is a frame shape member whose longitudinal direction is +Y and −Y directions. The frame 71 has step-shaped side walls 71*a* and 71*b*. Positions of upper end surfaces of the side walls 71*a* and 71*b* are stepped higher at distance of an equal ratio from the −Y side to the +Y side.

More specifically, the side wall 71*a* has four parts, namely a side wall part a1, a side wall part a2, a side wall part a3, and a side wall part a4. The height of the side wall part a1 is lowest. The side wall part a2 is provided at the +Y side of the side wall part a1 and higher than the side wall part al by a designated length. The side wall part a3 is provided at +Y side of the side wall part a2 and higher than the side wall part a2 by a designated length. The side wall part a4 is provided at +Y side of the side wall part a3 and higher than the side wall part a3 by a designated length.

Similarly, the side wall 71*b* has four parts, namely a side wall part b1, a side wall part b2, a side wall part b3, and a side wall part b4. The side wall part b1 has the same height as that of the side wall part a1 of the side wall 71*a*. The side wall part b2 is provided at +Y side of the side wall part b1 and has the same height as that of the side wall part a2 of the side wall 71*a*. The side wall part b3 is provided at +Y side of the side wall part b2 and has the same height as that of the side wall part a3 of the side wall 71*a*. The side wall part b4 is provided at +Y side of the side wall part b3 and has the same height as that of the side wall part a4 of the side wall 71*a*.

A +Y side end of the side wall 71*a* and a +Y side of the side wall 71*b* are connected by the side wall 71*c*. A −Y side end of the side wall 71*a* and a −Y side of the side wall 71*b* are connected by the side wall 71*e*. A middle part of the side wall 71*a* and a middle part of the side wall 71*b* are connected by the side wall 71*d*.

The elastic hinges 72A, 72B, 72C, and 72D are provided at a −X side of the side wall 71*a*. The elastic hinges 72E, 72F, 72G, and 72H are provided at a +X side of the side wall 71*b*. The elastic hinges 72A, 72B, 72C, 72D, 72E, 72F, 72G, and 72H have common configurations and functions. Accordingly, details of the structure of the elastic hinge 72A are illustrated in FIG. 8, and explanation and illustration in FIG. 8 of details of the structures of other elastic hinges 72B, 72C, 72D, 72E, 72F, 72G, and 72H are omitted.

Figure 8:
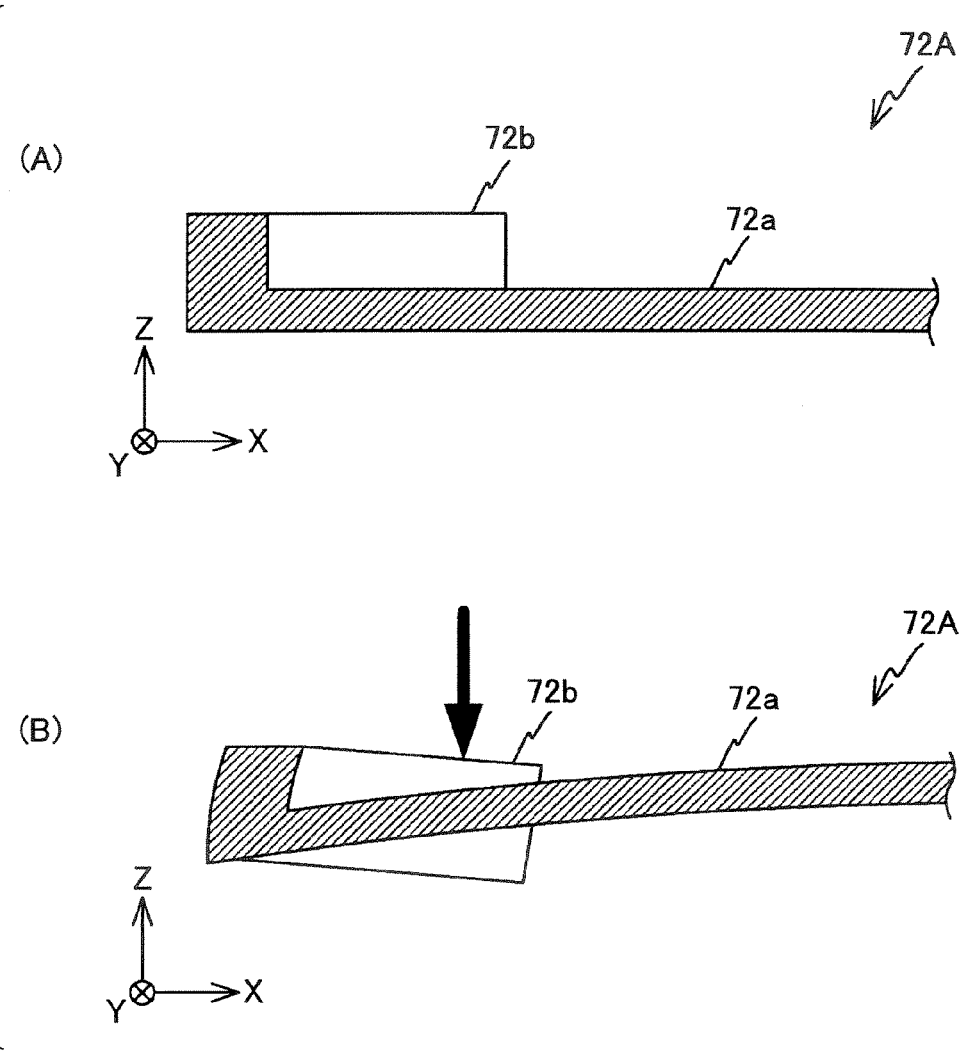
FIG. 8 is a view for explaining an elastic hinge 72A of the intermediate member 70.

FIG. 8 is a view for explaining an elastic hinge 72A of the intermediate member 70.

As shown in FIG. 7 and FIG. 8(A), the elastic hinge 72A includes a hinge part 72*a* and a supporting part 72*b*. The hinge part 72*a* having a rectangular shape configuration extends from the vicinity of a center upper end part of the side wall part a1 of the side wall 71*a* in a −X direction. The supporting part 72*b* has a U-shaped plan view and a plate-shaped configuration. The supporting member 72*b* is thicker than the hinge part 72*a*. The hinge part 72*a* is put between parts facing each other of the supporting part 72*b*. A lower end of a part corresponding to a lower side part of the U shape is connected to a −X side end of the hinge part 72*a*.

As shown in FIG. 8(B), when a pressing force in a direction indicated by the arrow is applied, the hinge part 72*a* of the elastic hinge 72A is curved downward in a concave manner and an elastic force in the +Z direction corresponding to the pressing force due to bending of the connection part of the supporting part 72*b* and the hinge part 72*a* is generated as the supporting part 72 is rotated counterclockwise in FIG. 8(B).

The elastic hinges 72B, 72C, 72D, 72E, 72F, 72G, and 72H have the same structure as the elastic hinge 72A. The elastic hinges 72B, 72C, and 72D are provided in the vicinity of the center upper end part of the side wall parts a2, a3, and a4, respectively, of the side wall 71*a*. The elastic hinges 72E, 72F, 72G, and 72H are provided in the vicinity of the center upper end part of the side wall parts b1, b2, b3, and b4, respectively, of the side wall 71*b*.

Referring back to FIG. 7, eight stoppers 73 are provided in the center of the upper ends of the side wall parts a1, a2, a3, and a4 of the side wall part 71*a* and in the center of the upper end of the side wall parts b1, b2, b3, and b4 of the side wall part 71*b*, on a circular cylinder having a longitudinal direction that is in the +Z and −Z directions.

In addition, circular cylinder shape leg parts 75 are provided in positions corresponding to the stoppers 73 provided at the upper end of the side wall parts a1 through a4 at the lower ends of the side wall parts a1 through a4. The leg parts 75 are provided in positions corresponding to the stoppers 73 provided at the upper ends of the side wall parts b1 through b4 at the lower ends of the side wall parts b1 through b4.

Figure 9:
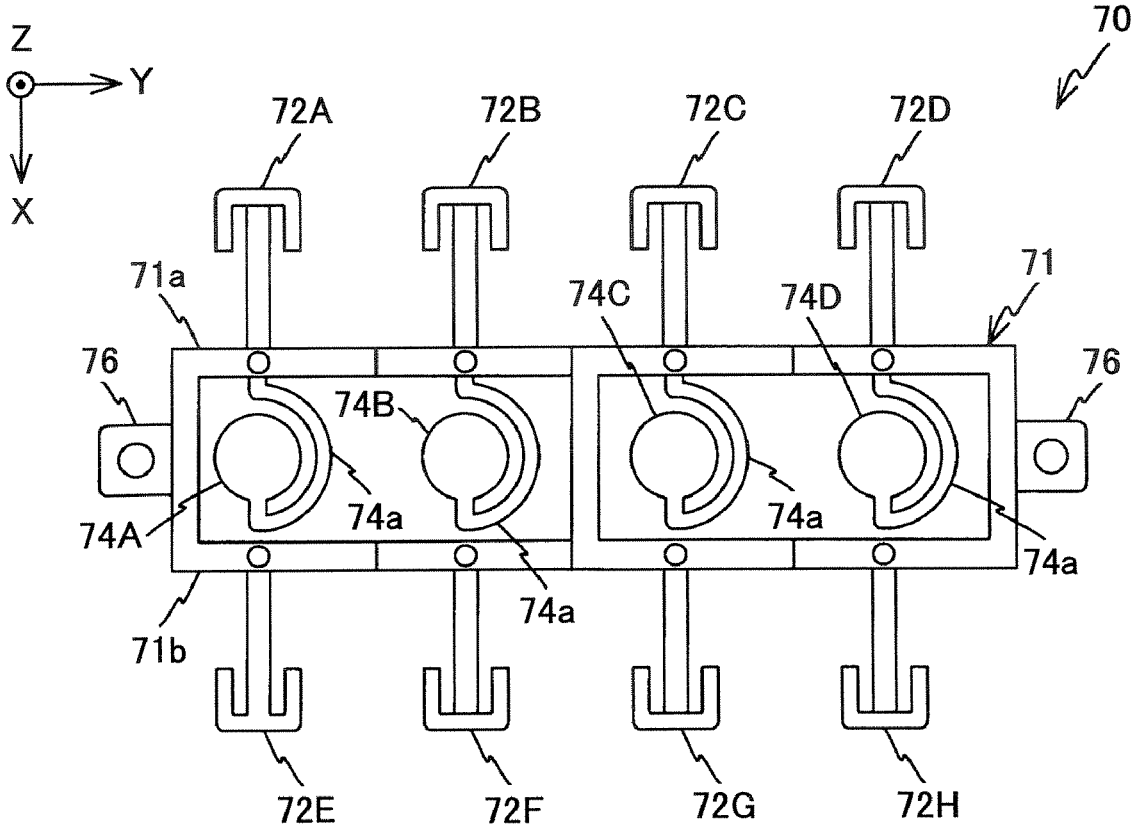
FIG. 9 is a plan view of the intermediate member 70.

FIG. 9 is a plan view of the intermediate member 70. The spacers 74A through 74D are circular cylinders whose longitudinal directions are +Z and −Z direction. As shown in FIG. 7 and FIG. 9, the spacer 74A is put between the side wall part a1 of the side wall 71*a* and the side wall part b1 of the side wall 71*b*. As shown in FIG. 9, the spacer 74A can be moved in upper and lower directions against (relative to) the side wall 71*a* in an elastically deformable range of a curved hinge 74*a* by the curved hinge 74*a*. One end of the curved hinge 74*a* is fixed to a +X side of the side wall 71*a* and the other end of the curved hinge 74*a* is fixed to a +X side of the spacer 74A.

As shown in FIG. 7, the spacer 74B is a circular cylinder higher than the spacer 74A. The spacer 74B is put between the side wall part a2 of the side wall 71*a* and the side wall part b2 of the side wall 71*b*. As shown in FIG. 9, the spacer 74B can be moved in upper and lower directions against the side wall 71*a* in an elastically deformable range of a curved hinge 74*a* by the curved hinge 74*a*. One end of the curved hinge 74*a* is fixed to a +X side of the side wall 71*a* and the other end of the curved hinge 74*a* is fixed to a +X side of the spacer 74B.

As shown in FIG. 7, the spacer 74C is a circular cylinder higher than the spacer 74B. The spacer 74C is put between the side wall part a3 of the side wall 71*a* and the side wall part b3 of the side wall 71*b*. As shown in FIG. 9, the spacer 74C can be moved in upper and lower directions against the side wall 71*a* in an elastically deformable range of a curved hinge 74*a* by the curved hinge 74*a*. One end of the curved hinge 74*a* is fixed to a +X side of the side wall 71*a* and the other end of the curved hinge 74*a* is fixed to a +X side of the spacer 74C.

As shown in FIG. 7, the spacer 74D is a circular cylinder higher than the spacer 74C. The spacer 74D is put between the side wall part a4 of the side wall 71*a* and the side wall part b4 of the side wall 71*b*. As shown in FIG. 9, the spacer 74D can be moved in upper and lower directions against the side wall 71*a* in an elastically deformable range of a curved hinge 74*a* by the curved hinge 74*a*. One end of the curved hinge 74*a* is fixed to a +X side of the side wall 71*a* and the other end of the curved hinge 74*a* is fixed to a +X side of the spacer 74D.

As shown in FIG. 7 and FIG. 9, the extending parts 76 have substantially square configurations having circular holes provided in the center. The extending parts 76 are provided at a lower end at a +Y side of the side wall 71*c* of the frame 71 and at a lower end at a −Y side of the side wall 71*e* of the frame 71.

Figure 10:
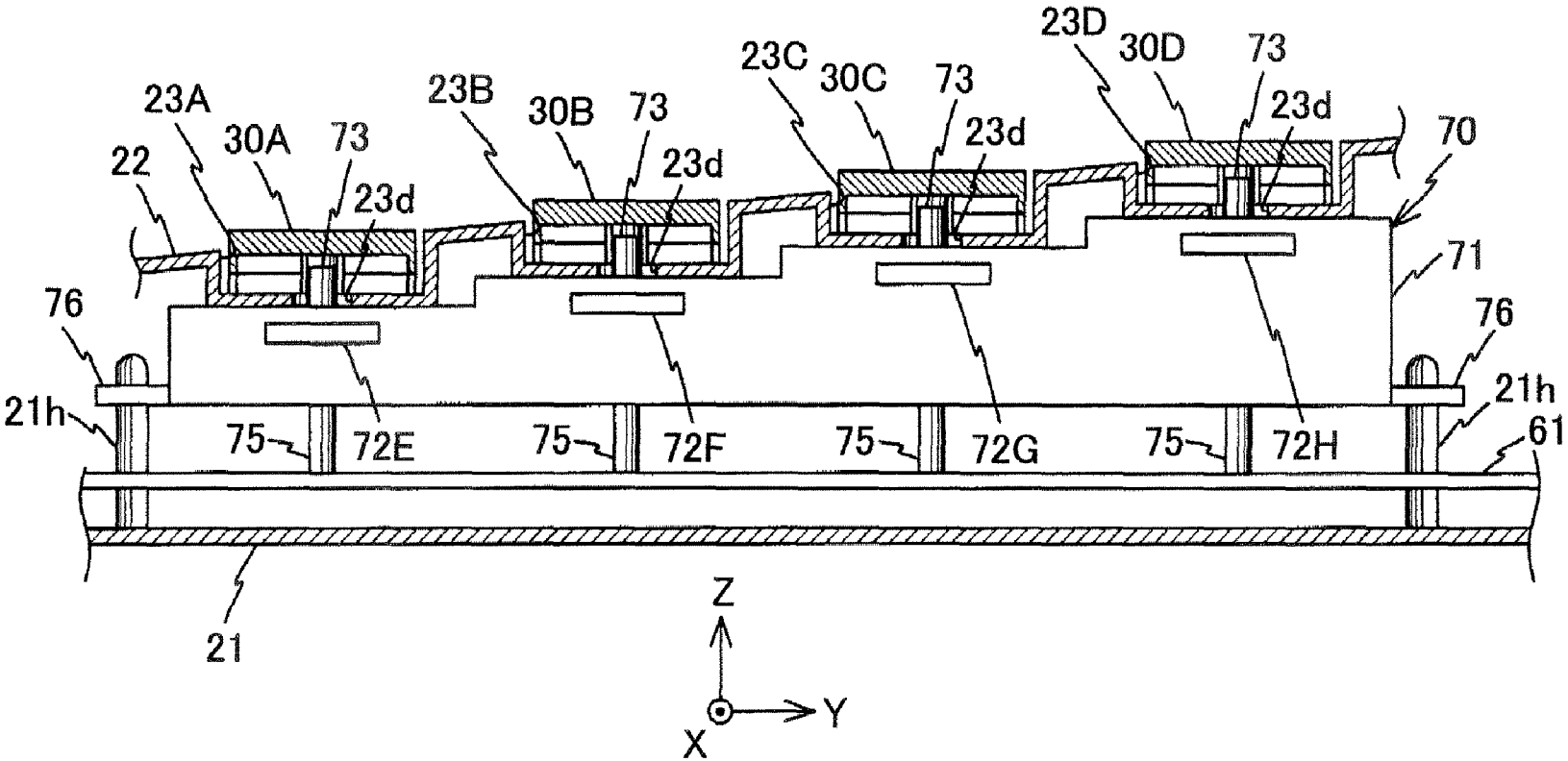
FIG. 10 is a side view of the intermediate member 70, more specifically, a partial side view of a cover 22, key tops 30A through 30D, a base 21, and the intermediate member 70.

FIG. 10 is a side view of the intermediate member 70, more specifically, a partial side view of the cover 22, the key tops 30A through 30D, the base 21, and the intermediate member 70. As shown in FIG. 10, the intermediate member 70 stands on the board 61 by the leg parts 75 provided with the frame 71.

In a state where the stoppers 73 provided on the side wall part a1 and the side wall part b1 are inserted into the pair of the circular hole forming parts 23*d* of the concave part 23A, upper end surfaces of the side wall part a1 and the side wall part b1 press the bottom wall of the concave part 23A of the cover 22. In a state where the stoppers 73 provided on the side wall part a2 and the side wall part b2 are inserted into the pair of the circular hole forming parts 23*d* of the concave part 23B, upper end surfaces of the side wall part a2 and the side wall part b2 press the bottom wall of the concave part 23B of the cover 22. In a state where the stoppers 73 provided on the side wall part a3 and the side wall part b3 are inserted into the pair of the circular hole forming parts 23*d* of the concave part 23C, upper end surfaces of the side wall part a3 and the side wall part b3 press the bottom wall of the concave part 23C. In a state where the stoppers 73 provided on the side wall part a4 and the side wall part b4 are inserted into the pair of the circular hole forming parts 23*d* of the concave part 23A, upper end surfaces of the side wall part a4 and the side wall part b4 press the bottom wall of the concave part 23D of the cover 22. As a result of this, the intermediate member 70 is put between the board 61 and the cover 22.

At this time, the pair of projection parts 21*h* formed at the frame 71, piercing the board 61, and projecting in upper directions, are inserted into the circular holes of the pair of the extending parts 76 formed in the frame 71, so that positions in +X and −X directions and +Y and −Y directions are fixed.

Figure 11:
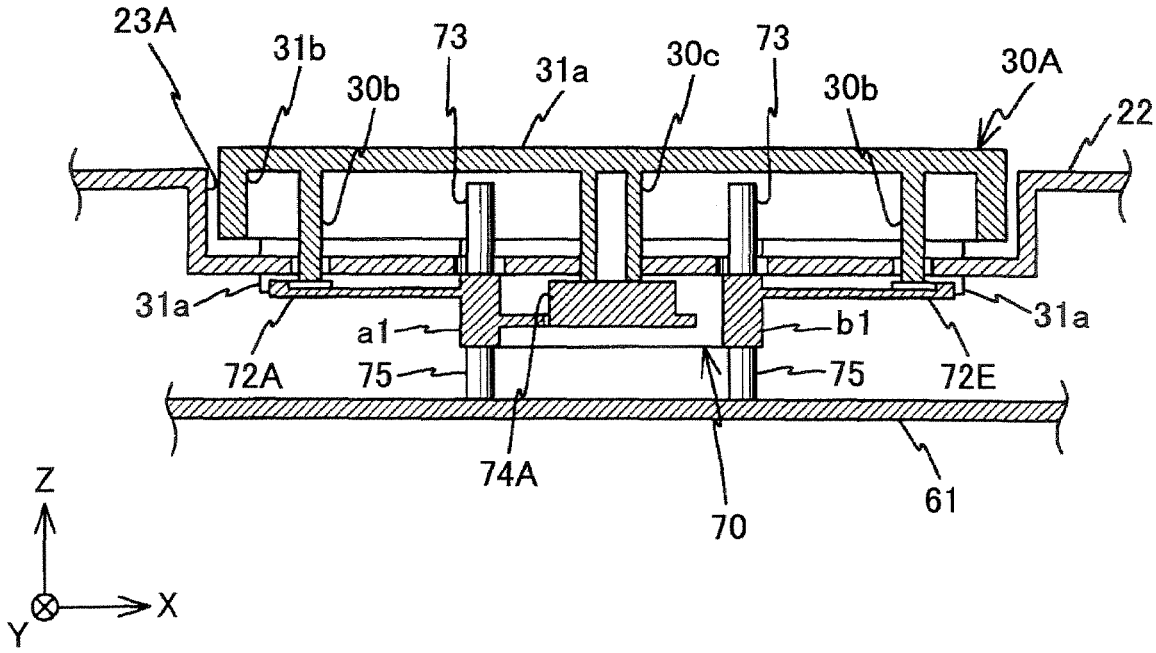
FIG. 11 is a partial cross-sectional view showing a cross-section taken along a line B-B of FIG. 2.

FIG. 11 is a partial cross-sectional view showing a cross section taken along a line B-B of FIG. 2. As shown in FIG. 11, in a state where the lower end of the operations part 30*c* comes in contact with the upper surface of the spacer 74A of the intermediate member 70, the pair of guide ribs 30*b* is energized upwardly by the elastic hinges 72A and 72E so that the key top 30A is supported by the intermediate member 70. Similarly, in a state where the lower end of the operations part 30*c* comes in contact with the upper surfaces of the spacer 74B, 74C, and 74D, via the elastic hinges 70B, 70C, 70D, 70F, 70G, and 70H, the key tops 30B, 30C, and 30D, respectively, are supported by the intermediate member 70.

Figure 12:
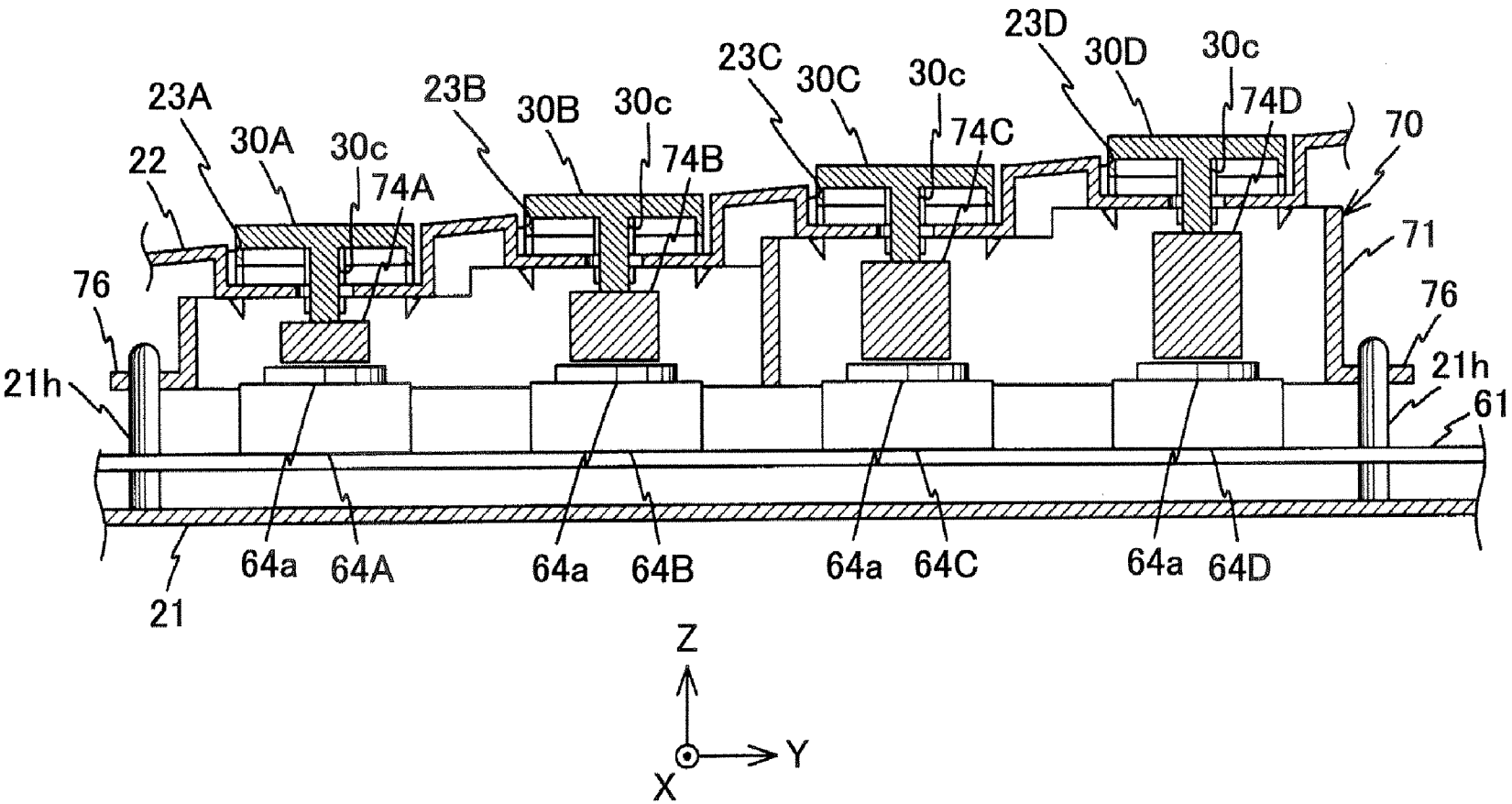
FIG. 12 is a side view of switches 64A through 64D, more specifically, the cover 22, the key tops 30A through 30D, the base 21 and the intermediate member 70.

FIG. 12 is a side view of switches 64A through 64D, more specifically, the cover 22, the key tops 30A through 30D, the base 21 and the intermediate member 70.

As shown in FIG. 12, the above-mentioned four switches 64A through 64D are rectangular parallelepiped shape tact switches having electrical contacts inside. The switches 64A through 64D have circular cylindrical shape sliders 64*a* which can slide in +Z and −Z directions.

The slider 64*a* is always energized upward, namely in the +Z direction by an energizing mechanism not shown in FIG. 12 but provided inside the switch 64. The slider 64*a* slides downward, namely in the −Z direction, by a pressing force applied from an outside so that the electrical contact inside the switch 64 is turned on.

The switch 64A is mounted on the upper surface of the board 61 so that the center of the slider 64*a* is substantially positioned directly under the spacer 74A of the intermediate member 70. The switch 64B is mounted on the upper surface of the board 61 so that the center of the slider 64*a* is substantially positioned directly under the spacer 74B of the intermediate member 70. The switch 64C is mounted on the upper surface of the board 61 so that the center of the slider 64*a* is substantially positioned directly under the spacer 74C of the intermediate member 70. The switch 64D is mounted on the upper surface of the board 61 so that the center of the slider 64*a* is substantially positioned directly under the spacer 74D of the intermediate member 70.

Figure 13:
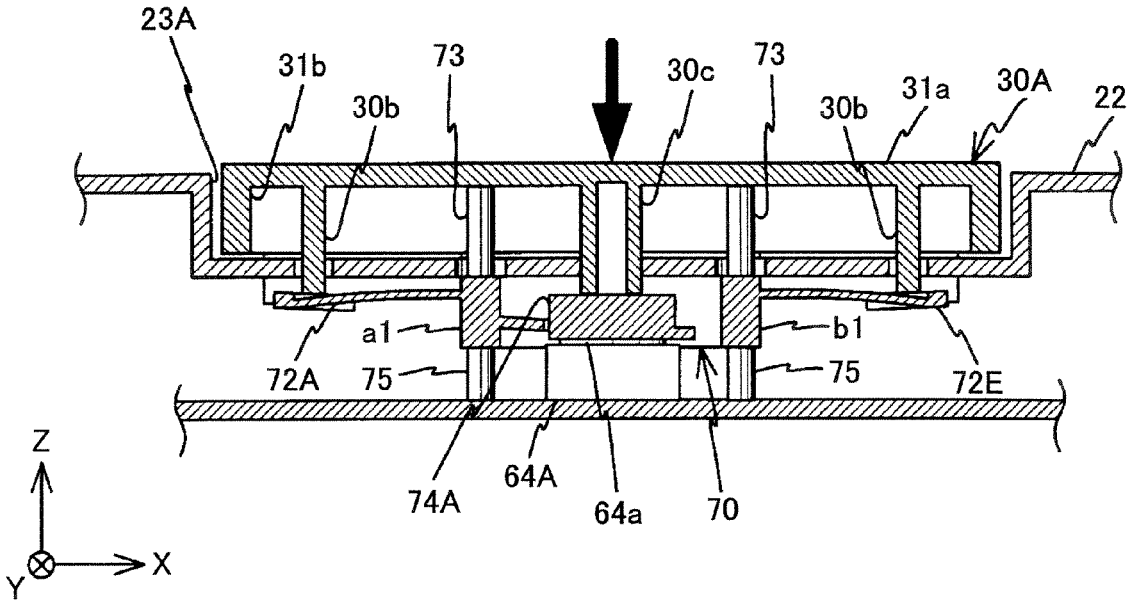
FIG. 13 is a view for explaining operation of the intermediate member 70.

FIG. 13 is a view for explaining operation of the intermediate member 70.

As shown in FIG. 13, when a pressing force in a direction indicated by the arrow is applied to a pressing part 31*a* of the key top 30A, the key top 30A goes down while the key top 30A bends the elastic hinges 72A and 72E of the intermediate member 70. The key top 30A stops going down in a position where the lower surface of the pressing part 31*a* comes in contact with the upper end of the pair of the stoppers 73 of the intermediate member 70.

On the other hand, the spacer 74A of the intermediate member 70 is pushed down by the operations part 30*c* of the key top 30A so that the slider 64*a* of the switch 64A goes down and the electrical contact of the switch 64A is turned on.

When the pressing force applied to the key top 30A is turned off, upward elastic forces generated by the elastic hinges 72A and 72E of the intermediate member 70 are applied to the lower end part of the guide rib 30*b* so that the key top 30A is returned to a position shown in FIG. 11 and the electrical contact of the switch 64A is turned off.

Similarly, when pressing forces are applied to pressing parts 31*a* of the key tops 30B, 30C, and 30D, electrical contacts of the switches 64B, 64C and 64D are turned on via the spacers 74B, 74C and 74D, respectively. When the pressing forces are turned off, the electrical contacts of the switched 64B, 64C and 64D are turned off.

As discussed above, in the operations panel 20 of this embodiment, the key top 30A (30B, 30C, 30D) is, as shown in FIG. 5(A) and FIG. 11, supported in a upper limit position of a stroke defined by the hook part 30*w* of the leg part 30*a* and the bottom wall of the concave part 23A (23B, 23C, 23D) in the state where the key top 30A (30B, 30C, 30D) is energized by the elastic hinges 72A and 72E of the intermediate member 70. Accordingly, vibration of the key top 30A (30B, 30C, 30D), due to vibration generated when the copier 100 is operated or vibration transferred from the outside, is not generated. Therefore, it is possible to improve the operations feeing and operability.

In addition, as shown in FIG. 12, the spacer 74A (74B, 74C, 74D) having thickness corresponding to the distance between the lower end of the operations part 30*c* of the key top 30A (30B, 30C, 30D) and the upper end of the slider 64*a* of the corresponding switch 64A (64B, 64C, 64D) is provided directly under the operations part 30*c* of the key top 30A (30B, 30C, 30D). Therefore, as shown in FIG. 12, even if each of the distances between the key top 30A, 30B, 30C, and 30D and the corresponding switches 64A, 64B, 64C, and 64D is different due to design of the upper surface of the cover 22 or the like, such difference of the distance are compensated for by the spacers 74A, 74B, 74C, and 74D. Accordingly, it is possible to make the configurations of the key tops 30A, 30B, 30C, and 30D common and thereby manufacturing costs can be reduced.

Furthermore, as shown in FIG. 8, the elastic hinge 72A (72B through 72H) of the intermediate member 70 is formed by, for example, two parts, the hinge part 72*a* extending in the −X direction and the supporting part extending from a −X end of the hinge part 72*a* in the +X direction. If the elastic hinge 72A is regarded as a uniform body, a folding part of a two-step structure is formed by a connection part of the supporting part 72*b* so that the hinge part 72*a* and it is possible to secure sufficient elasticity by the folding part. Therefore, even if a space where the hinge part 72*a* is extended is small, it is possible to secure sufficient elasticity with space savings by supporting the key top 30A (30B, 30C, 30D) with the supporting part 72*b* as the folding part.

In addition, as shown in FIG. 13, a lower limit of the stroke of the key top 30A (30B, 30C, 30D) is defined by contact of the upper end of the stopper 73 provided at the intermediate member 70 and the lower surface of the pressing part 31*a* of the key top 30A (30B, 30C, 30D). Therefore, even if an excessive pressing force is applied to the key top 30A (30B, 30C, 30D), plastic deformation of the elastic hinges 72A through 72H exceeding a elastically deformable range is not generated so that the elastic hinges 72A through 72H are not broken. Furthermore, the switch 64A (64B, 64C, 64D) is not damaged.

Furthermore, since the copier 100 of the embodiment of the present invention has the operations panel 20, it is possible to improve the operability while the manufacturing cost is reduced.

The present invention is not limited to these embodiments, but variations and modifications may be made without departing from the scope of the present invention.

In the above discussed embodiment, the spacers 74A through 74D are provided under the key tops 30A through 30D. However, the present invention is not limited to this structure. For example, as long as the operations part 30*c* of the key top 30A having a smallest gap with the switch has sufficient length for operating the switch 64A, the spacer 74A may be omitted. In other words, in a case where plural key tops are arranged with different gaps for the switch, a configuration of the key top having the smallest gap with the switch is set as a standard and spacers corresponding to the gap between the operations part and the switch are provided at only other key tops, so that making parts common can be realized. In this case, for example, instead of the spacer 74A of the intermediate member 70, a piercing hole where the operations part 30*c* of the key top 30A can be slid may be provided.

Furthermore, in the above discussed embodiment, four key tops 30A through 30D are provided on the upper surface of the cover 22. However, the present invention is not limited to this structure. Three or less or five or more key tops may be provided on the upper surface of the cover 22.

In addition, in the above discussed embodiment, the operations panel 20 and the push-button mechanism having the key tops 30A through 30D are used for the copier. However, the present invention is not limited to this structure. The present invention may be applied an image forming apparatus other than the copier, such as a printer, facsimile, multi-function apparatus formed by combining the copier, printer, and the facsimile.

Thus, according to the embodiment of the present invention, it is possible to provide an operations panel wherein a board having an upper surface where a plurality of switches is provided is provided in a housing, the operations panel including: a base where the board is arranged; a cover forming the housing together with the base, the cover having an upper surface having a part where a plurality of concave parts is formed in positions corresponding to the switches; a plurality of key tops provided at the concave parts from outside in a state where operations parts and projection parts including engaging claws are inserted via a plurality of openings formed in the concave parts; and an intermediate member provided between the cover and the board, the intermediate member including a plurality of elastic members, a plurality of spacers, and a main body where the elastic members and the spacers are provided in a body, the elastic members individually giving an energizing force in a direction separating the switches from the corresponding key tops, the spacers having thicknesses corresponding to gaps between the operations parts of the key tops and the corresponding switches and individually moving in the same directions accompanying movement of the key tops, the directions approaching to or separating from the corresponding switches.

In the above-mentioned image forming apparatus, plural key tops provided at the cover of the operations panel reciprocally move in directions approaching to or separating from the switch provided on the board and are held in positions furthest from the switches by elastic forces of the elastic members. Accordingly, even if there is play between the operations part and the switches, it is possible to improve the operational feeing and operability of the key tops without vibration of the key tops.

Furthermore, even if the gaps between the operations part of the key tops and the switches vary for every key top, the pressing forces applied to the key tops are effectively transferred to the switches by moving the space, together with the key stops, having the thickness corresponding to the distance between the key stops and the switches to the switches. Therefore, even if each of the distances between the key tops and the corresponding switches provided on the cover is different due to design of the housing of the operations panel, it is possible to make the configurations of the key tops common and thereby manufacturing cost of the push-button mechanism can be reduced.

In the operations panel, the elastic member may include a folding part. The intermediate member may include a plurality of stoppers, the stoppers being configured to limit the movement when the key tops approach to the switches corresponding to the key tops.

In addition, according to the embodiment of the present invention, it is possible to provide an image forming apparatus, including: the operations panel as mentioned above; and an image forming apparatus main body where the operations panel is at least electrically connected.

The image forming apparatus has the above-discussed operations panel. Accordingly, it is possible to improve the operational feeling and operability while the manufacturing cost of the image forming apparatus is reduced.

This patent application is based on Japanese Priority Patent Application No. 2005-335586 filed on Nov. 21, 2005, the entire contents of which are hereby incorporated by reference.

What is claimed is:

1. An operations panel wherein a board having an upper surface where a plurality of switches is provided is provided in a housing, the operations panel comprising:

a base where the board is arranged;

a cover forming the housing together with the base, the cover having an upper surface having a part where a plurality of concave parts is formed in positions corresponding to the switches;

a plurality of key tops provided at the concave parts from outside in a state where operations parts and projection parts including engaging claws are inserted via a plurality of openings formed in the concave parts; and an intermediate member provided between the cover and the board, the intermediate member including a plurality of elastic members, a plurality of spacers, and a main body where the elastic members and the spacers are provided in a body, the elastic members individually giving an energizing force in a direction separating the switches from the corresponding key tops, the spacers having thicknesses corresponding to gaps between the operations parts of the key tops and the corresponding switches and individually moving in the same directions accompanying movement of the key tops, the directions approaching to or separating from the corresponding switches.

2. An image forming apparatus, comprising:

the operations panel as set forth in claim 1; and an image forming apparatus main body where the operations panel is at least electrically connected.

3. The operations panel as claimed in claim 1, wherein the intermediate member includes a plurality of stoppers, the stoppers being configured to limit the movement when the key tops approach to the switches corresponding to the key tops.

4. An image forming apparatus, comprising:

the operations panel as set forth in claim 3; and an image forming apparatus main body where the operations panel is at least electrically connected.

5. The operations panel as claimed in claim 1, wherein the elastic member includes a folding part.

6. An image forming apparatus, comprising:

the operations panel as set forth in claim 5; and an image forming apparatus main body where the operations panel is at least electrically connected.

7. The operations panel as claimed in claim 5, wherein the intermediate member includes a plurality of stoppers, the stoppers being configured to limit the movement that the key tops approach to the switches corresponding to the key tops.

8. An image forming apparatus, comprising:

the operations panel as set forth in claim 7; and an image forming apparatus main body where the operations panel is at least electrically connected.

* * * * *